US005222613A

United States Patent [19]

McGhie

[11] Patent Number: 5,222,613

[45] Date of Patent: Jun. 29, 1993

[54] PIVOTALLY-MOUNTED REEVED COUNTERWEIGHT SYSTEM

[76] Inventor: James R. McGhie, 4362 Metcalf Dr., Eagan, Minn. 55122

[21] Appl. No.: 764,620

[22] Filed: Sep. 24, 1991

[51] Int. Cl.[5] ..... B66C 23/72; B66C 23/76

[52] U.S. Cl. ..... 212/195; 212/196; 212/198; 212/178

[58] Field of Search ..... 212/195-198, 212/167, 169, 178, 223, 245, 255, 260, 264, 266, 237

[56] References Cited

U.S. PATENT DOCUMENTS

| | | | |
|---|---|---|---|
| 1,877,373 | 9/1932 | Cohen-Venezian . | |
| 2,856,706 | 10/1958 | Hacker . | |
| 3,140,857 | 7/1964 | Nickles . | |
| 3,375,021 | 3/1968 | Grider . | |
| 3,393,758 | 7/1968 | Helm et al. . | |
| 3,547,278 | 12/1970 | Tayler . | |
| 3,653,486 | 4/1972 | McLean et al. . | |
| 3,836,010 | 9/1974 | Lampson . | |
| 3,851,776 | 12/1974 | Leyrat . | |
| 3,893,572 | 7/1975 | Axelsson et al. . | |
| 3,902,735 | 9/1975 | Bertram et al. . | |
| 3,938,669 | 2/1976 | Vinton . | |
| 3,945,518 | 3/1976 | Inoue . | |
| 3,955,684 | 5/1976 | Novotny . | |
| 3,977,530 | 8/1976 | Helm et al. . | |
| 4,042,115 | 8/1977 | Beduhn et al. . | |
| 4,103,783 | 8/1978 | Beduhn et al. . | |
| 4,197,953 | 4/1980 | Frick . | |
| 4,201,305 | 5/1980 | Frick . | |
| 4,204,603 | 5/1980 | Ducreuzet . | |
| 4,258,852 | 3/1981 | Jeurgens . | |
| 4,316,548 | 2/1982 | Helm et al. . | |
| 4,333,889 | 6/1982 | McGrew . | |
| 4,358,021 | 11/1982 | Helm et al. . | |
| 4,387,814 | 6/1983 | Beduhn et al. . | |
| 4,449,635 | 5/1984 | Helm et al. . | |
| 4,498,596 | 2/1985 | Haulotte . | |
| 4,537,317 | 8/1985 | Jensen . | |
| 4,540,097 | 9/1985 | Wadsworth et al. . | |
| 4,555,032 | 11/1985 | Mick et al. . | |
| 4,601,402 | 7/1986 | Helm et al. . | |
| 4,679,336 | 7/1987 | Brocklebank et al. . | |
| 4,711,358 | 12/1987 | Konishi | 212/178 |
| 4,716,729 | 1/1988 | Kakeya . | |
| 4,729,486 | 3/1988 | Petzold et al. . | |
| 4,788,820 | 12/1988 | Sakai et al. . | |
| 4,995,518 | 2/1991 | McGhie | 212/178 |
| 5,018,630 | 5/1991 | McGhie | 212/233 |

FOREIGN PATENT DOCUMENTS

| | | |
|---|---|---|
| 1264010 | 3/1968 | Fed. Rep. of Germany . |
| 2017058 | 4/1970 | Fed. Rep. of Germany . |

OTHER PUBLICATIONS

1100 SUPER SKY HORSE Machine Specifications Am. Hoist & Derrick Company.

900 Serils SKY HORSE Counterblaance Crane American Hoist & Derrick Company.

*Primary Examiner*—Joseph F. Peters, Jr.
*Assistant Examiner*—Kenneth Lee
*Attorney, Agent, or Firm*—Palmatier, Sjoquist & Helget

[57] ABSTRACT

A pivotally-mounted reeved counterweight system for a counterbalance-type crane which includes a wheeled counterweight carriage supporting a counterweight. A yoke provides the coupling means pivotally connecting the carriage and the rearward end of the platform or deck also known as the counterweight arm. A sheave is mounted on the yoke. The rope, which manipulates the boom upwardly and downwardly, retractably and extensibly extends from a hoist drum on the platform upwardly and is reeved about a mast sheave and extends downwardly, rearwardly and upwardly between the yoke sheave and a plurality of platform sheaves and mast sheaves.

21 Claims, 5 Drawing Sheets

PIVOTALLY-MOUNTED REEVED COUNTERWEIGHT SYSTEM

BACKGROUND OF THE INVENTION

This invention relates to counterbalance-type heavy lift cranes for use in the construction industry, and more particularly to a pivotally-mounted, reeved counterweight system connected to the rearward end of the crane deck or platform of a mobile or fixed counterbalance type crane assembly.

Most construction companies will have one or more general, all-purpose truck crane or crawler cranes which are used in the majority of lifting and moving projects encountered in a typical construction project. Such cranes currently have reached the size and weight limitations for ease of transport among the various job sites on public roads while the lifting capacity requirements of the construction industry have continued to increase.

Designers of portable lift cranes have been faced with the problem of creating a portable crane that is readily transportable among the various job sites within existing highway size and weight regulations while increasing the lift capacity of the crane. There have been various methods of making the counterweights both rearwardly extendible from the crane platform or deck as well as removable from either the platform or from their connection from behind the crane and platform.

Removable counterweight and counterweights detachable from the crane for transportation by another vehicle have been built and are known. The problem with removable counterweights is that they require perhaps another crane to place and remove the counterweight between the crane and a transport vehicle. Other removable counterweight systems require substantial disassembly to reduce their weight for transportation. Wheeled counterweights that rigidly and rearwardly extend from a counterweight arm on the platform are plagued with the problem of jerking the boom of the crane, as they move or rotate simultaneously. Also, such wheeled counterweights do not provide adequate counterweight for most cranes. Most of their counterweight force is borne by the wheels on the ground and not by the counterweight arm or boom thereby decreasing the lift capacity of the crane while still problematically increasing the total mass of the crane assembly.

Another problem with counterweights that extend from the counterweight arm or the deck of the crane is structural stress upon the deck or counterweight arm and the rotational pivot point of the deck. This stress is caused by having the counterweight located substantially rearward of the rotation point of the deck and having such counterweights substantially supported by the deck or counterweight arm which causes structural fatigue or buckling of portions of the deck or platform.

Apart from counterweighting the boom, crane backward stability is also important. The crane industry is looking for a simple and lower cost method of counterweighting a crane to prevent forward tipping where the problem of backward stability is also solved. In the past, backward crane stability, which must be considered in designing a crane, required extensive assembly time with costly components. One such example is the AMERICAN SKY HORSE® made by the American Hoist & Derrick Company. The SKY HORSE® sells for around $400,000.

There is a need for a counterweight system for a counterbalance-type crane with a counterweight arm extending rearwardly from the crane's rotatable deck or platform. Such a system suitably would include a pivotally-mounted wheeled counterweight carriage that would not put excessive stress forces or fatigue on the counterweight arm or crane platform. Such a system should greatly increase the crane's lifting capacity limited only by the structural limitations of the other elements of the crane assembly such as the ropes, pendants, and perhaps the boom itself. The system should assemble quickly and cost under $100,000.

SUMMARY OF THE INVENTION

A pivotally-mounted, reeved counterweight system for a counterbalance-type crane which includes a wheeled counterweight carriage supporting a counterweight. A yoke provides the coupling means pivotally connecting the carriage and the rearward end of the platform or deck also known as the counterweight arm. A sheave is mounted on the yoke. The rope, which manipulates the boom upwardly and downwardly, retractably and extensibly extends from a hoist drum on the platform upwardly and is reeved about a mast sheave and extends downwardly, rearwardly and upwardly between the yoke sheave and a plurality of platform sheaves and mast sheaves.

A principal object and advantage of the present invention is that the pivotally-mounted, reeved counterweight system increases the crane lifting capacity up to and beyond 60 percent.

Another object and advantage of the system is that the wheeled counterweight has two pivotal connections between it and the counterweight arm or rearward end of the deck permitting the wheeled counterweight to follow its arcuate radial path over somewhat uneven terrain in a smooth fashion as to not shake the boom.

Another object and advantage of the present system is that the deck or platform and rearwardly directed counterweight arm connection is not subjected to stress or fatigue by way of the full weight of the wheeled counterweight carriage on the platform due to the pivotal connection between the wheeled counterweight and platform. This arrangement permits the counterweight to rest on the ground which eliminates the possibility of the crane back tipping without a load on the boom. That is, when there is no load on the boom, all the counterweight force is taken through the ground due to the pivotal connections thereby eliminating all moment force on the crane.

Another object and advantage of the system is a flexible connection between the yoke and the rearward end of the platform to securely hold the counterweight carriage outwardly, rearwardly and rigid with respect to the platform should the crane tip forwardly due to too heavy a load on the boom.

Another object and advantage of the present invention is that the counterweight system is of a relatively low cost in the neighborhood of $95,000 and sets up relatively quickly and easily in approximately two hours.

DETAILED SPECIFICATION

The present invention utilizes many of the standard elements found on a truck crane, crawler crane or fixed crane assembly. Although the invention as described herein is with reference to the truck-mounted crane assembly 10 of the counterbalance type, it should be understood that the necessary elements are also found on other types of cranes which may easily be available for use with the pivotally-mounted, reeved counterweight system 57 of the present invention. Further still, the sizes of the crane 10, counterweights, masts, boom, number of sheaves and other settings herein are strictly for purposes of illustrating the preferred embodiment and are not to be taken as restrictive with respect to the scope of the invention.

Figure 1:
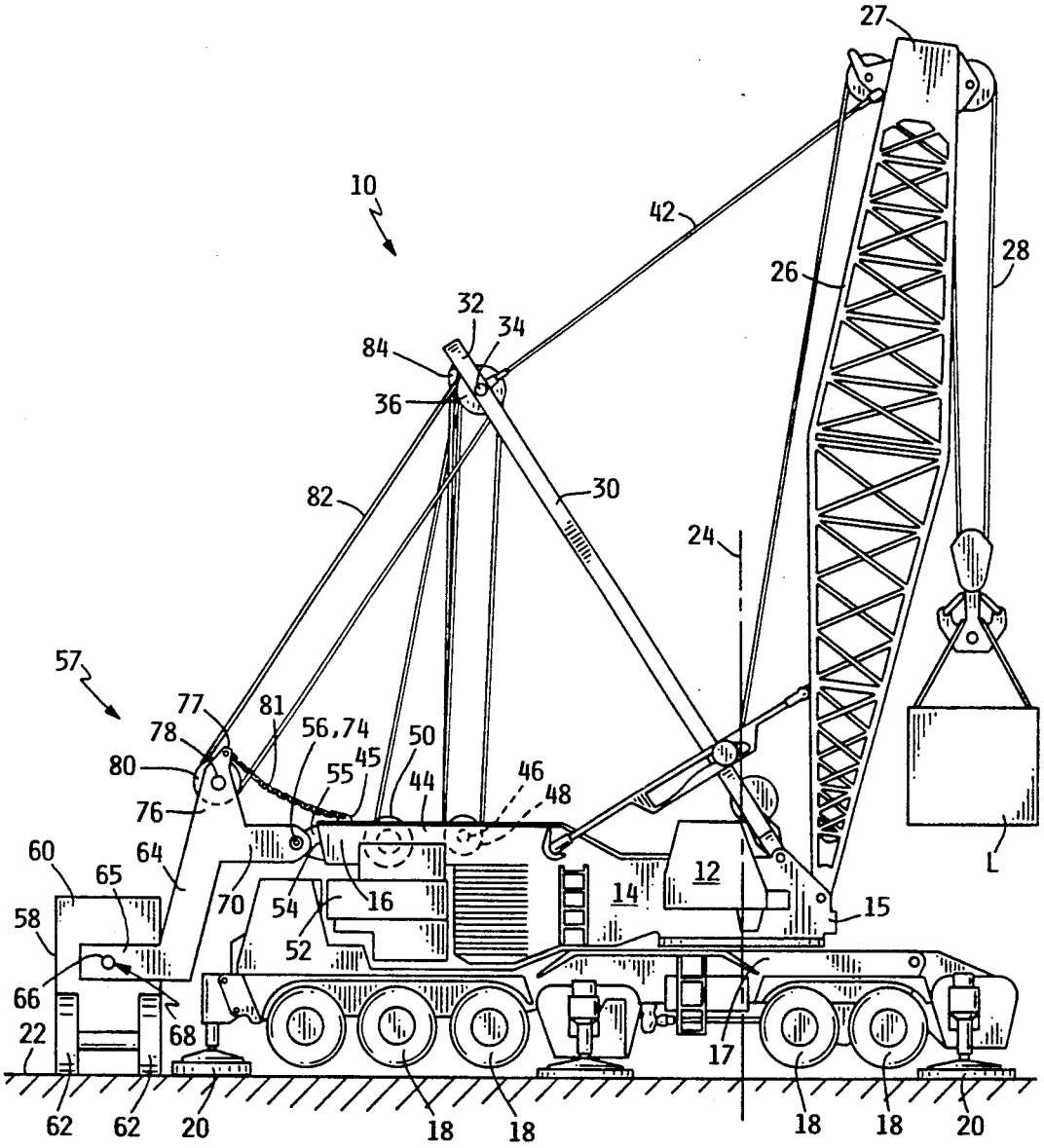
FIG. 1 is a side elevational view of the pivotally-mounted, reeved counterweight system attached to a conventional truck-mounted counterbalance-type crane.
Figure 2:
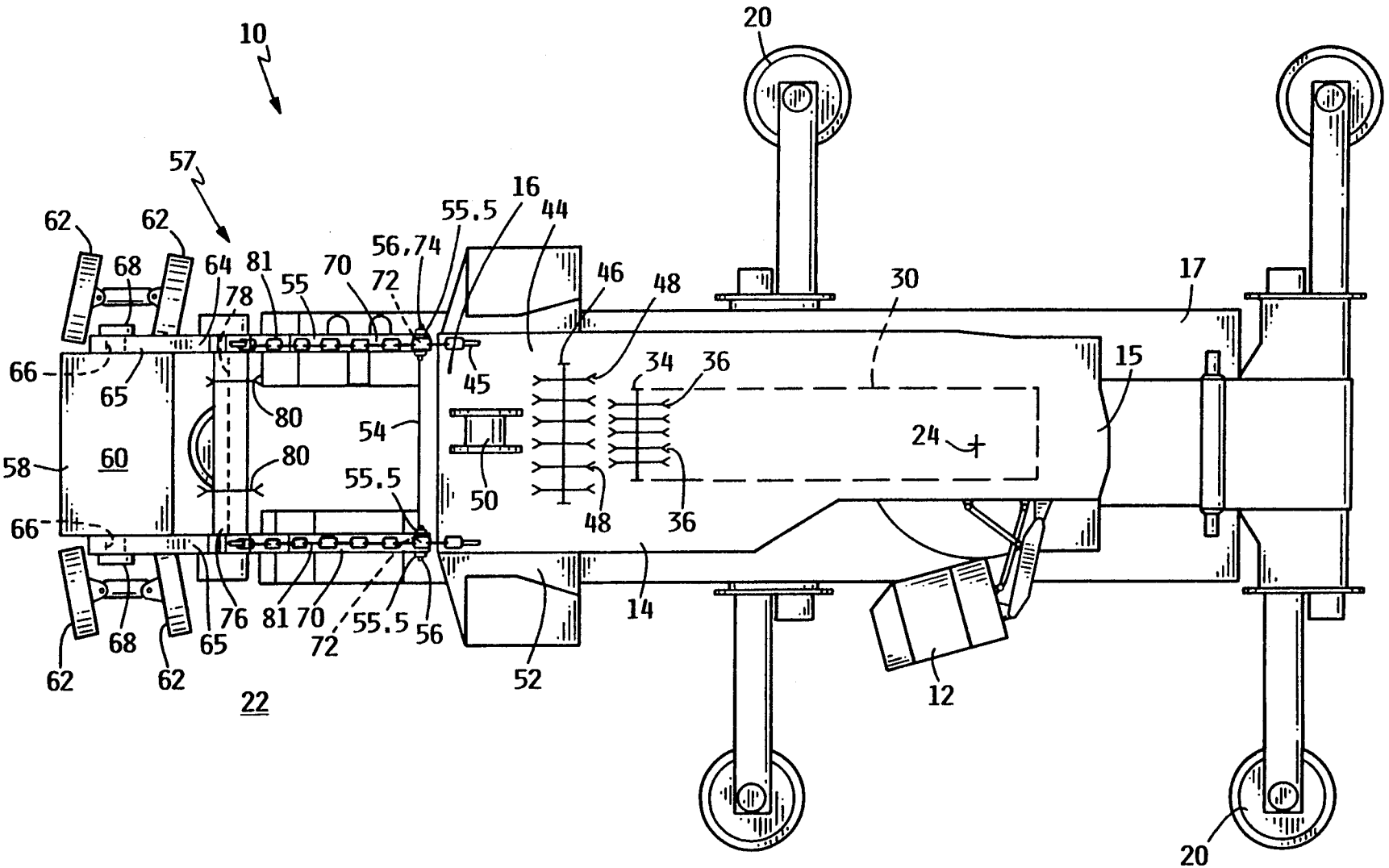
FIG. 2 is a top plan view of the crane and counterweight system with the boom and mast broken away and the sheaves of the system shown schematically.

Referring to FIGS. 1 and 2, the truck-mounted crane assembly 10 suitably may be a 400-ton counterbalance-type crane. The crane 10 has an operating cab 12, a pivotal or rotatable platform or deck 14 which is somewhat elongate having a forward end 15 and rearward end 16. The platform 15 is rotatably supported on a transport vehicle 17 which otherwise may be the ground-borne base. Vehicle 17 illustratively has wheels 18 and outriggers 20 which contact the ground 22. The deck platform 14 rotates about first axis 24 as so the deck rearward end 16 swings arcuately in a radial manner about the pivot axis 24.

Crane assembly 10 also includes boom 26 which is pivotally mounted at the forward end 15 of platform or deck 14. Boom 26 has a boom tip or upper end 27. A load line or rope 28 extends upwardly from a hoist drum on the platform 14 about the boom tip 27 and downwardly in front of the crane for picking up objects or loads L with the boom 26. A mast 30 is also pivotally mounted adjacent the forward end 15 of the deck 14. The mast 30 extends upwardly and rearwardly and also has a mast tip or upper end 32.

Figure 3:
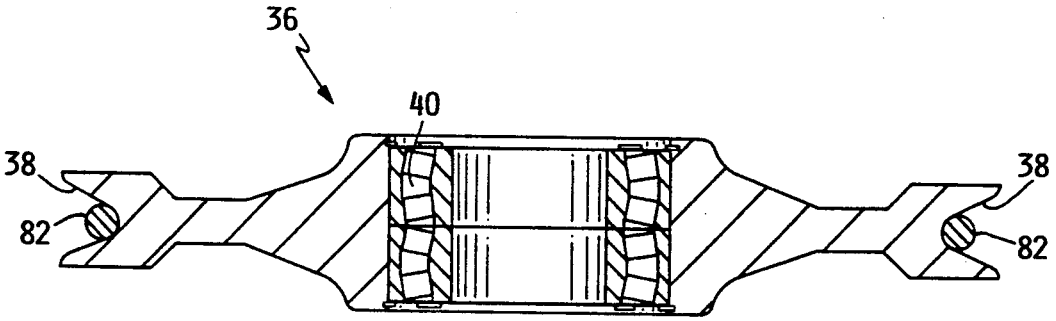
FIG. 3 is a cross-sectional view of one of the sheaves of the system.

The mast tip 32 supports a transverse shaft or rod 34 upon which are mounted sheaves 36. In this particular example there are six sheaves 36.1, 36.2, 36.3, 36.4, 36.5 and 36.6 mounted on shaft 34 located at mast tip 32. FIG. 3 gives more detail of the sheaves utilized in the crane assembly 10 and the pivotally-mounted reeved counterweight system 57 of the present invention. Sheaves 36 are disc like and have a circumferential, annular or peripheral channel 38 which will receive, support and guide a crane rope, line or pendant. Sheave 36 also has a central aperture and bearing assembly 40 through which a shaft, such as shaft 34, may pass therethrough. Central bearing assembly 40 may also be packed with heavy grease before mounting on shaft 34.

Boom 26 is pivotally mounted and designed to have its boom tip 27 move upwardly and closer to the vertical pivot axis 24 or downwardly and away from the vertical pivot axis 24 as to raise and lower the boom 26 in a generally forward direction. A fixed pendant 42 typically is used to connect the boom tip to the mast tip 32. The purpose of the mast 30 is to support the boom 25 as further will be appreciated herein. Extending rearwardly from and part of the platform or deck 14 is counterweight arm or extension 44 which terminates at rearward end 16 of deck 14.

Intermediate of the counterweight arm 44, or between the forward end 15 and rearward end 16 of deck 14, is located another transverse shaft or rod 46 which supports a plurality of platform sheaves 48. Illustratively in this case there are six deck sheaves 48.1, 48.2, 48.3, 48.4, 48.5 and 48.6. Rearwardly and sidewardly of the sheaves 48 is located a hoist drum 50 about which is wrapped a boom hoist rope 82 discussed further herein. Platform 14 may also suitably support its own counterweights 52, which illustratively in this case may be 185,000 pounds for a 400-ton crane 10. At the rearward end 16 of platform 14 or counterweight arm 44 is located the distal end 54 of platform 14. As seen in FIGS. 1 and 2, the distal end 54 may support pairs of mounting brackets or ears 55 extending in a rearward direction, or pairs of mounting ears 55.5 extending in an upward direction. Ears 55 and 55.5 have apertures therethrough for receiving and supporting pivot pins 56. Ears 55 and 55.5 together with pins 56 permit connecting an attachment to the rearward end 16 of platform 14.

The pivotally-mounted, reeved counterweight system 57 of the present invention generally includes a counterweight carriage 58 supporting a counterweight 60 which illustratively in this case may be 125,000 pounds. The counterweight system 57 further includes a coupling means 64 for pivotally connecting the counterweight carriage 58 to the rearward end 16 of the platform 14. The coupling means 64 supports sheaves 80 while the standard boom hoist rope 82 retractably and extensibly extends upwardly from the hoist drum 50 and is reeved about a mast sheave 36 and extends downwardly, rearwardly and upwardly between the coupling means sheave 80 and a plurality of platform sheaves 48.1 through 48.6 and mast sheaves 36.1 through 36.6.

More specifically, the counterweight carriage 58 suitably has four wheels 62 arcuately aligned as to permit the counterweight carriage 58 to move in an arcuate or radial fashion as platform 15 rotates about first pivot axis 24. The coupling means 64 includes a yoke, coupler, linkage or hitch 64 which permits the pivotal connection between the counterweight carriage 58 and the platform 14. Yoke 64 illustratively appears to be generally H-shaped from its top view while the side elevational view of FIG. 1 shows that yoke 64 takes the form of a pivotally-mounted lever which gives mechanical advantage.

Yoke 64 has carriage extensions or legs 65 where at their ends are located apertures, holes, pivotal mounts or connections 66 alignable and attachable with counterweight carriage 58. Pivot pins 68 suitably may connect the pivotal connections 66 with the carriage 58. By this arrangement the yoke 64 may move upwardly and downwardly with respect to the counterweight carriage 58 at pivot axis 68. Yoke 64 also has counterweight arm extensions or legs 70 where at which their ends are located pivot connection mounts, apertures or holes 72 suitably alignable with the ears 55 or 55.5 of the rearward end 16 of platform 14. Through the pivotal connections or apertures 72, pivot pins 56 may pass which will create another pivot axis 74 which will permit yoke 64 to pivot upwardly and downwardly with respect to platform 14 at pivot axis 74.

Located on yoke 64 is a sheave bracket mount 76 which extends upwardly somewhat. Sheave bracket 76 appropriately extends between and rigidly connects yoke extensions 65 and 70. Sheave bracket 76 appropriately supports a shaft or rod 78 upon which are located counterweight sheaves 80.1 and 80.2. It is appropriate and relatively important to note that sheaves 80 and brackets 76 are relatively close to pivot axis 74 rather than pivot axis 68. This is suitably necessary. As the upward and forward pulling force of boom 26 is exerted upon sheaves 80, the yoke 64 will act as a lever pivotally mounted at axis 74. By this arrangement, great mechanical advantage with respect to a counterweight is achieved as heretofore not known for any other counterweight system.

The reeving of rope 82 will now be discussed and is shown schematically in the reeving diagram of FIG. 4. Initially, rope 82 extensibly and retractably is wound about hoist drum 50. Rope 82 then extends upwardly 82.1 and reeved about mast sheave 36.1 and downwardly 82.2 (broken line) to be reeved about counterweight or yoke sheave 80.1 and upwardly 82.3 to be reeved about mast sheave 36.2 and downwardly (broken line) 83.4 to be reeved about platform sheave 48.2 and upwardly 83.5 to be reeved about mast sheave 36.3 and downwardly 83.6 to be reeved about platform sheave 48.3 and upwardly 83.7 to be reeved about mast sheave 36.4 and downwardly 83.8 to be reeved about platform sheave 48.4 and upwardly 83.9 to be reeved about mast sheave 36.5 and downwardly 83.10 to be reeved about platform sheave 48.5 and upwardly 83.11 to be reeved about mast sheave 36.6 and downwardly 83.12 to be reeved about counterweight or yoke sheave 80.2 and upwardly 83.13 to be tied or fastened at dead end 84.

The sheaves 48 and 36 as well as hoist drum 50 are generally standard in all crane assemblies 10. After the counterweight carriage is hitched to platform 14, the modification of an existing crane assembly 10 to connect the counterweight system 57 of the present invention is simply a matter of reeving rope 82 about yoke sheaves 80.1 and 80.2, mast sheaves 36.1–36.6 and platform sheaves 48.2–48.5. The two platform sheaves 48.1 and 48.6 remain idle and are not reeved by rope 82.

Figure 5:
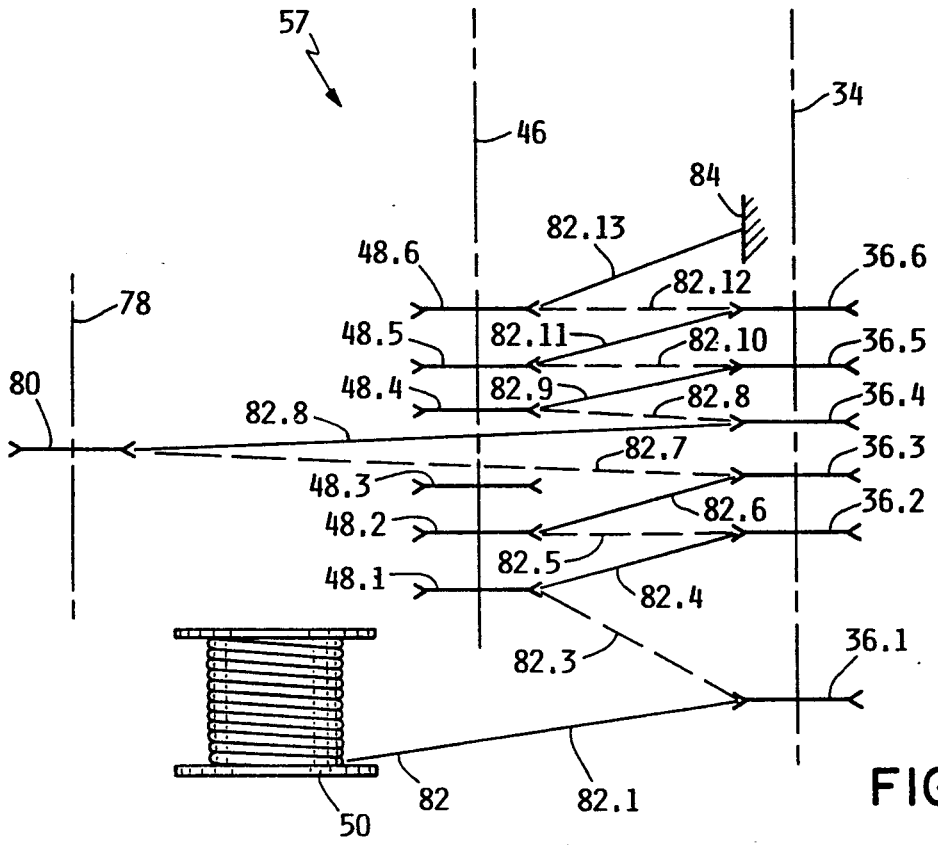
FIG. 5 is a schematic reeving diagram showing an alternative arrangement of reeving the boom hoist rope about the sheaves of the system.
Figure 6:
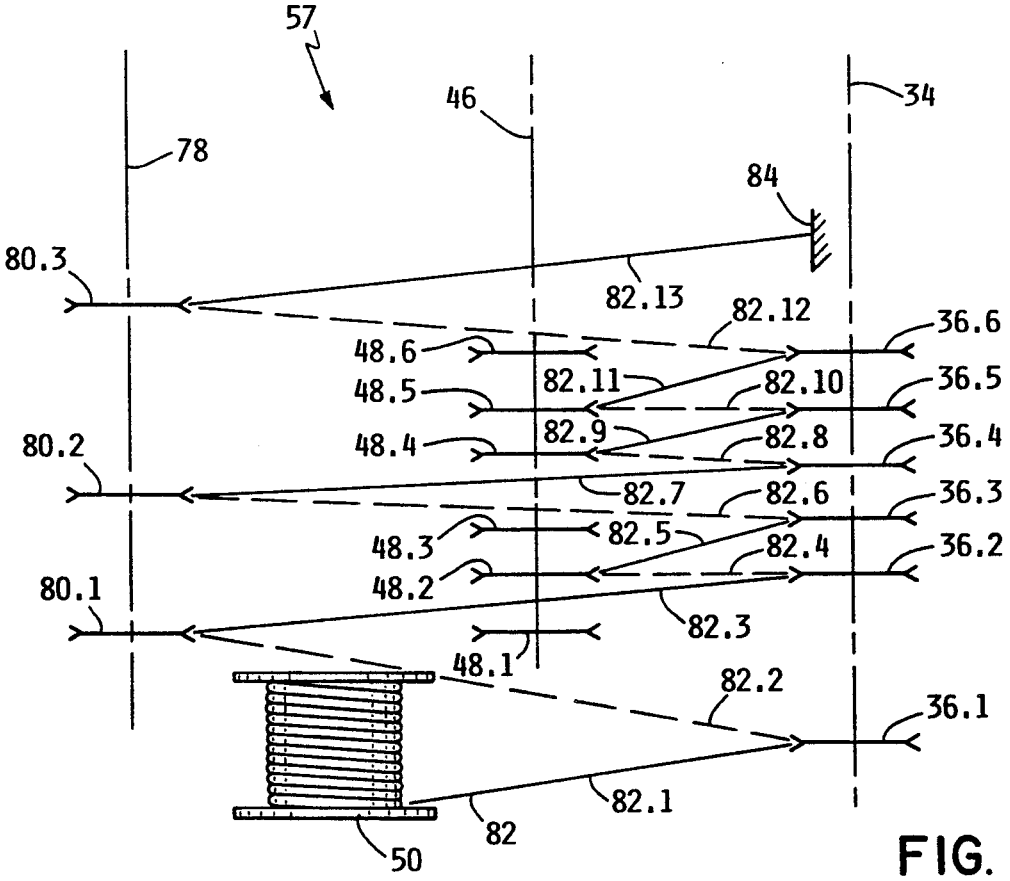
FIG. 6 is a schematic reeving diagram showing another alternative arrangement of reeving the boom hoist rope about the sheaves of the system.

The possible reeving arrangements between a plurality of counterweight sheaves 80, platform sheaves 48 and mast tip sheaves 36 are quite numerous. Whatever the reeving arrangement, the result is the beneficial advantage of the pivotally-mounted, reeved counterweight system 57 of the present invention. FIGS. 5 and 6 show two alternative reeving diagrams schematically.

Referring to FIG. 5, the rope 82 of the crane assembly 10 extensibly and retractably extends upwardly 82.1 from hoist drum 50 and is reeved about mast sheave 36.1 and extends downwardly 82.3 and is reeved about platform sheave 48.1 and extends upwardly 82.4 and is reeved about mast sheave 36.2 and extends downwardly 82.5 and is reeved about platform 48.2 and extends upwardly 82.6 and is reeved about mast sheave 36.3 and extends downwardly 82.7 and is reeved about counterweight or yoke sheave 80 and extends upwardly 82.8 and is reeved about mast sheave 36.4 and extends downwardly 82.9 and is reeved about platform sheave 48.4 and extends upwardly 82.9 and is reeved about mast sheave 36.5 and extends downwardly 82.10 as reeved about platform sheave 48.5 and extends upwardly 82.11 and is reeved about mast sheave 36.6 and extends downwardly 82.12 and is reeved about platform sheave 48.6 and extends upwardly 82.13 and is tied off or fastened at dead end 84.

Referring to FIG. 6, another reeving arrangement of rope 82 may be seen. Initially, rope 82 retractably and extensibly extends from hoist drum upwardly 82.1 to be reeved about mast sheave 36.1 and downwardly 82.2 to be reeved about yoke sheave 80.1 and upwardly 82.3 to be reeved about mast sheave 36.2 and downwardly 82.4 to be reeved about platform sheave 48.2 and upwardly 82.5 to be reeved about mast sheave 36.3 and downwardly 82.6 to be reeved about yoke sheave 80.2 and upwardly 82.7 to be reeved about mast sheave 36.4 and downwardly 82.8 to be reeved about platform sheave 48.4 and upwardly 82.9 to be reeved about mast sheave 36.5 and downwardly 82.10 to be reeved about platform sheave 48.5 and upwardly 82.11 to be reeved about mast sheave 36.6 and downwardly 82.12 to be reeved about yoke sheave 80.3 and upwardly 82.10 to be fastened to dead end 84.

Figure 4:
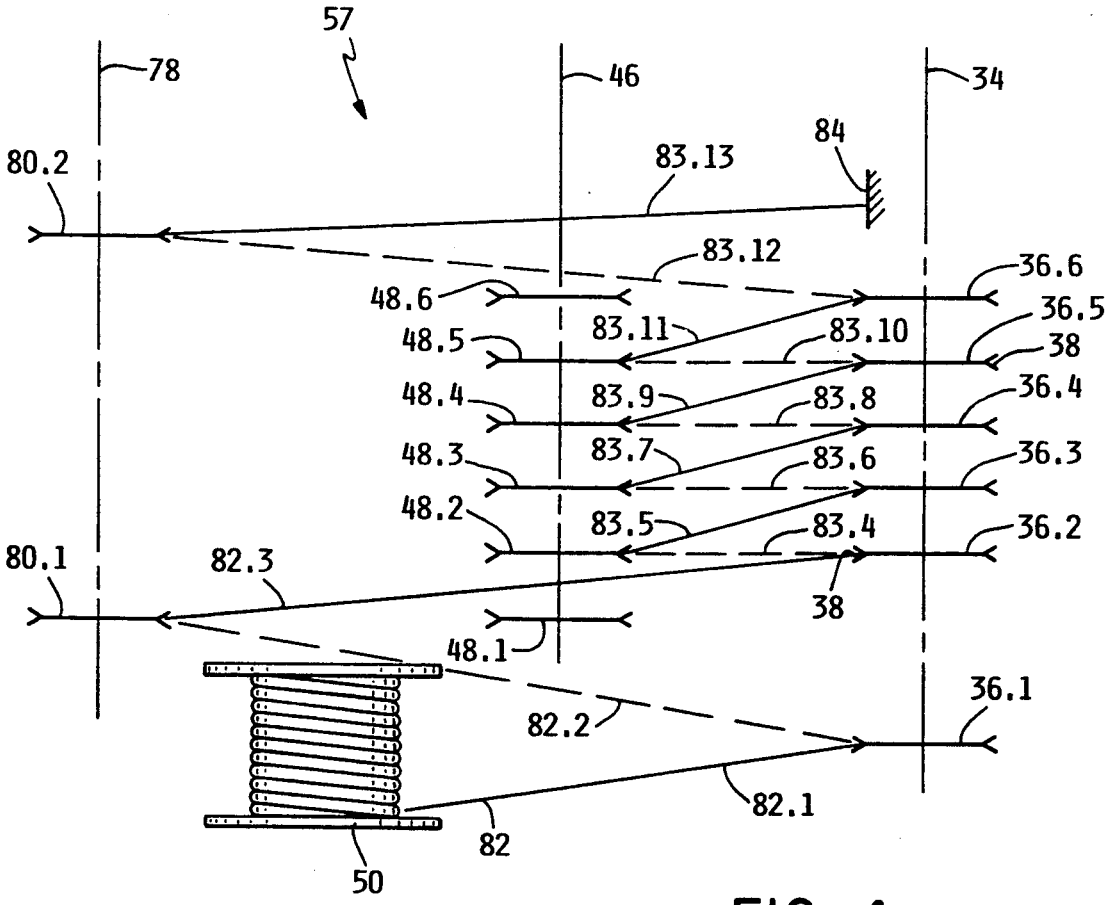
FIG. 4 is a schematic reeving diagram of the boom hoist rope about the sheaves of the system.

In viewing FIGS. 4–6, it is apparent that the existing sheaves 6 and 48 of the crane assembly 10 are suitably adequate for reeving the pivotally-mounted reeved counterweight system 57 of the present invention onto crane assembly 10. Each sheave 80 of the yoke 64 replaces one of the sheaves 48 of the platform. The replaced platform sheave then simply remains idle.

Assembly of the system 57 is simply a matter of connecting counterweight carriage 58 to the rearward end 16 of the platform 14 by way of yoke 64 and reeving rope 82 from drum 50 upwardly, downwardly and rearwardly between the counterweight sheaves 80 and a plurality of the mast sheaves 36 and platform sheaves 48. Assembly should be accomplished within two hours. FIGS. 4, 5 and 6 each illustrates a 13-part system 82.1-82.13. When considering the other limitations of specified crane assembly 10, such as the load limits of rope 82, pendant 42 and boom 26, counterweight 60 appropriately may be approximately 125,000 pounds to be placed on counterweight carriage 58 for a 400-ton crane.

With four rope segments 82.2, 82.3, 83.12 and 83.13 going to counterweight sheaves 80.1 and 80.2 and considering thirteen total rope segments 82.1–82.13, the reeving force or lifting force on the counterweight carriage at sheaves 80 may be calculated by the ratio 4:13. For example, a 400 ton crane assembly 10 may withstand a total reeving force of approximately 700,000 pounds. Seven Hundred Thousand pounds times the ratio 4:13 places 215,345 pounds of counterweight force at the counterweight sheaves 80. Recalling the mechanical advantage is created by locating sheaves 80 and bracket 78 somewhat close to yoke pivot axis 74. This arrangement creates a lever with great mechanical advantage so that the counterweight 60 on counterweight carriage 58 needs to only be 125,000 pounds.

With the crane 10 and system 57 set up for operation, all of the counterweight 60 force is borne by the ground 22 until the boom 26 picks up a load pulling on pendant 42 which pulls on the mast 30. The mast 30 in turn pulls upwardly on the counterweight carriage 58 through the rope 82 reeved about sheaves 80. After the load is released, the counterweight 60 force is again borne by the ground 22.

Apart from solely lifting a load L, the counterweight carriage 58 smoothly follows the deck 14 and counterweight arm 44 as the deck 14 swings or rotates on pivot axis 24. If the carriage 58 moves over uneven terrain or hits a bump, the boom 26 will not be significantly affected. For example, if the carriage 58 hits a bump and moves upwardly 6 inches, the mast might move downwardly but less than 1.3 inches. This reduction is due to the sheaves 36, 48 and 80, the reeving of rope 82 and the shape of pivotal lever or yoke 64. That is, the lever-shaped yoke 64 moves as to direct sheaves 80 upwardly only 3 inches with some forward movement. The four-part reeving 82 between sheaves 80 and 36 gives (3"×4 parts) 12 inches of rope slack. Because this is a thirteen part reeving arrangement, the mast 30 will move 12 inches divided by the nine remaining parts (12/9) or 1.3 inches along pendant 42. Because pendant 42 is angular with respect to boom 26, boom 26 will likely move less than 1.3 inches.

It is quite conceivable for various applications that the quantity of counterweight sheaves 80 may be varied. For example, the following chart shows the number of sheaves at the counterweight yoke 64 along with their respective force ratio and the likely required counterweight size requirements for crane assembly 10 described above.

| NUMBER OF COUNTERWEIGHT SHEAVES | FORCE RATIO | REQUIRED COUNTERWEIGHT (IN POUNDS) |
|---|---|---|
| 1 | 2:13 | 62,500 |
| 2 | 4:13 | 125,000 |
| 3 | 6:13 | 187,500 |
| 4 | 8:13 | 250,000 |

The system also has sheave mount bracket 76 somewhat elevated in relation to platform or deck 14. As drum 50 lets out rope 82 to permit the laying down of boom 26, the boom tip 27 moves away from vertical pivot axis 24 downwardly and forwardly. By this arrangement, ropes 82 do not interfere with platform 14 as the bracket and rope 82 are somewhat elevated when lowering boom 26 and mast 30.

At the top of elevated sheave mount brackets 76 suitably are located anchor connection mounting brackets or extensions 77. Yoke anchor connections 81 are suitably connected thereat and extend to mounting brackets or ears 45 on the rearward end 16 of platform 14. Yoke anchors suitably may taken the form of flexible connections or chains 81. Chains 81 should not be tight between their connectioning points 77 and 45 but also should not be excessively loose. Chains 81 perform the unique function of prohibiting crane 10 from tipping over forwardly should the load L exceed the lifting capacity of crane 10 and the counterweight system 57. That is, coupling means or yoke 64 will not permit counterweight carriage 58 to swing downwardly under or closer to platform 14 or vehicle 17 if the crane 10 tips forward. Rather, yoke 64 will be held to extend rearwardly and rigidly with respect to counterweight arm 44 of platform 14. With yoke 64 holding counterweight carriage 58 rigidly with respect to platform 14, the crane assembly 10 will likely come back down from a forward tip. This is a unique safety feature of the present invention.

The system 57 may be designed so that counterweight carriage 58 lifts upwardly and off the ground when the load L is applied to the boom 26. This arrangement eliminates any ground 22 or terrain interference no matter how slight. Also, the system's efficiency is somewhat increased as all of the counterweight 60 and carriage 58 weight is being utilized in the stability of the crane 10. This is achieved by using linearly expansible yoke anchor connections 90 as shown in FIGS. 7 through 9.

Yoke anchor 90 is of a linear expansible design which limits both the downward and upward range of movements of the counterweight carriage 58. Modified yoke anchor 90 consists of a sleeve 92 having opposing slots 94 intermediately arrange therethrough. Within sleeve 92 slide two opposing rods 96. Each rod 96 has a head 98 formed into a mounting bracket 100 suitably with apertures or holes 102 extending therethrough. The brackets 100 are readily alignable with counterweight ear or bracket 45 and anchor mount extension or bracket 77 after which pins 104 suitably may be located and fastened thereat to secure this arrangement. Rods 96 also appropriately have inner ends 108 and outwardly directing knobs or guides 106 alignable within the opposing slots 94 as may be seen.

Figure 7:
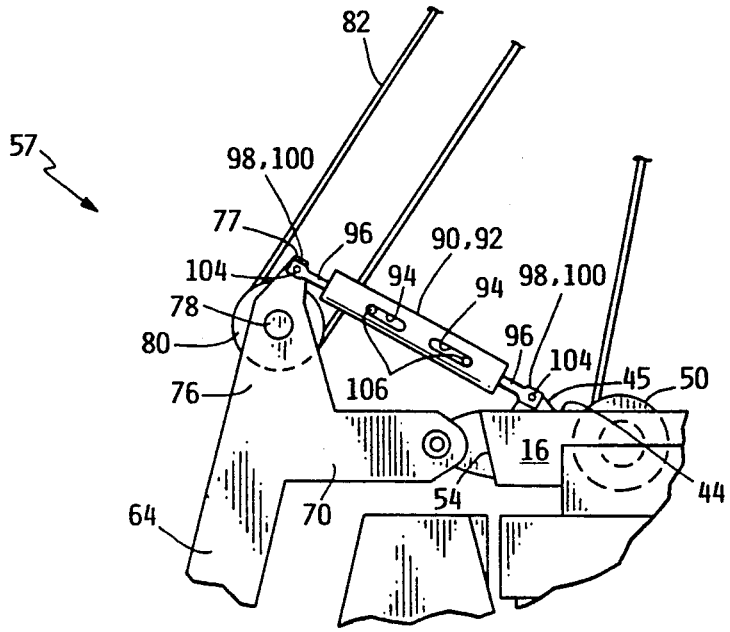
FIG. 7 is an enlarged detail view of an alternate yoke anchor connection arrangement broken away from the system.
Figure 8:
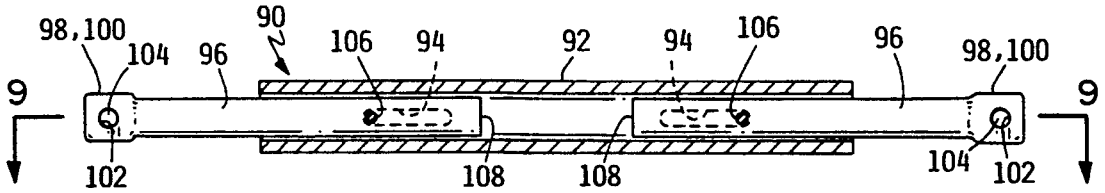
FIG. 8 is a side elevational view of the expanded yoke anchor connection taken along lines 8—8 of FIG. 9.
Figure 9:
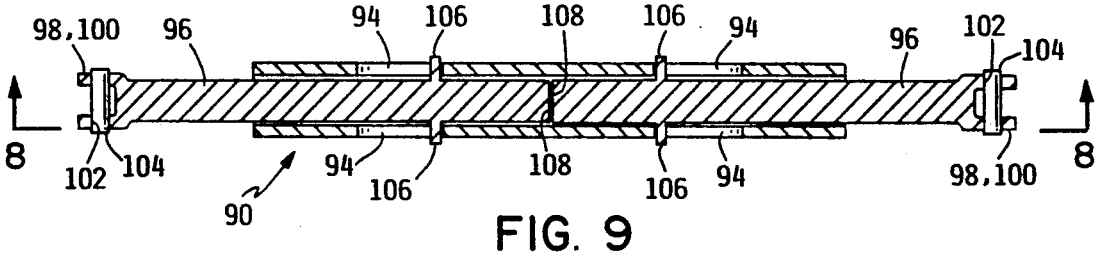
FIG. 9 is a top plan view of the contracted yoke anchor connection taken along lines 9—9 of FIG. 8.

By this arrangement, counterweight 60 and carriage 58's downward movement may be limited by the outwardly linear expansion of rods 96 to where knobs 106 reach the ends of slots 94, as shown in FIGS. 7 and 8, effectively operating as flexible connections or chains 81. Should it be desired that counterweight carriage 58 be operated off the ground 22, then counterweight sheaves 80 are lifted upwardly by reeving 82 to the point where the inner ends 108 of rods 96 abut as well as knobs 106 come to rest at the inward ends of opposing slots 94. By this arrangement, counterweight carriage 58, counterweight 60 and counterweight yoke sheaves 80 have a limited upward movement as to not adversely effect the boom 26 while yet increase the efficiency of the system 57 as the carriage is lifted off the ground.

The counterweight system 57 has been shown to greatly increase the ratings or lifting capacity of counterbalance-type cranes. With a typical 400 ton truck mounted counterbalance-type crane having 185,000 pounds on the crane assembly, and utilizing the pivotally-mounted reeved counterweight system 57 of the present invention, the crane assembly's lifting capacity can be increased up to and beyond 60 percent. In this arrangement, the counterweight yoke 64 would have two sheaves 80.1 and 80.2 with a counterweight 60 in the range of 125,000 pounds on counterweight dolly or carriage 58. This 400 ton crane would have lifting capacity increases depending upon the radius or distance from the load to the pivot 24 of the crane 10 according to the following table:

| RADIUS LOAD-PIVOT | APPROXIMATE LIFT INCREASE |
|---|---|
| 60 | 30% |
| 90 | 60% |
| 120 | 55% |

-continued

| RADIUS LOAD-PIVOT | APPROXIMATE LIFT INCREASE |
|---|---|
| 150 | 60% |

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A pivotally-mounted reeved counterweight system for a counterbalance-type crane characterized as having a rotatably mounted platform about a vertical pivot axis on a ground-borne base, the platform having a forward end, a rearward end, a boom pivotally extending upwardly and forwardly from adjacent the forward end of the platform with a tip, the boom adapted for picking up a load, a mast pivotally extending upwardly and rearwardly from adjacent the forward end of the platform with a tip and a sheave mounted adjacent the tip on the mast with a pendant connecting the tips of the boom and the mast, a sheave mounted on the platform, a hoist drum mounted on the platform and a rope retractably and extensibly extending from the drum and reeved about the sheaves for moving the boom tip upwardly and closer to the vertical pivot axis or downwardly and away from the vertical pivot axis, the system comprises:

(a) a wheeled counterweight carriage supporting a counterweight;

(b) a yoke pivotally connected to the carriage and the rearward end of the platform; and (c) a sheave mounted on the yoke, wherein the rope retractably and extensibly extends from the drum upwardly and is reeved about the mast sheave and extends downwardly, rearwardly and upwardly between the yoke sheave and a plurality of platform sheaves and mast sheaves.

2. The system of claim 1 wherein the yoke has two pairs of extensions, one pair being pivotally connected to the carriage and the other pair being pivotally connected to the rearward end of the platform.

3. The system of claim 1 wherein the yoke has an upward-extending bracket for mounting the sheave located intermediate the extensions.

4. The system of claim 3 wherein the yoke has two sheaves.

5. The system of claim 3 wherein the yoke has at least three sheaves.

6. The system of claim 1 further comprising a yoke anchor connection between the yoke means and the rearward end of the platform.

7. The system of claim 6 wherein the yoke anchor connection permits limited pivotal movement of the yoke.

8. A pivotally-mounted reeved counterweight system for a counterbalance-type crane characterized as having a rotatably-mounted platform about a vertical pivot axis on a ground-bourne base, the platform having a forward end, a rearward end, a boom pivotally extending upwardly and forwardly from adjacent the forward end of the platform with a tip, the boom adapted for picking up a load, a mast pivotally extending upwardly and rearwardly from adjacent the forward end of the platform with a tip and a sheave mounted adjacent the tip on the mast with a pendant connecting the tips of the boom and the mast, a sheave mounted on the platform, a hoist drum mounted on the platform and a rope retractably and extensibly extending from the drum and reeved about the sheaves for moving the boom tip upwardly and closer to the vertical pivot axis or downwardly and away from the vertical pivot axis, the system comprises:

(a) a wheeled counterweight carriage supporting a counterweight;

(b) a yoke with forward and rearward extensions, the rear extension pivotally connected to the carriage and the forward extension pivotally connected to the rearward end of the platform as to permit the counterweight force to rest on the ground; and (c) a sheave mounted on the yoke, the rope also being reeved between the sheaves of the yoke and the mast tip as to counterbalance the boom when the boom picks up a load.

9. The system of claim 8 wherein the yoke has an upward-extending bracket for mounting the sheave located intermediate the extensions.

10. The system of claim 9 wherein the yoke has two sheaves.

11. The system of claim 9 wherein the yoke has at least three sheaves.

12. The system of claim 8 wherein the coupling means has two sheaves and the platform and the mast have a plurality of sheaves.

13. The system of claim 8 wherein the rope retractably and extensibly extends from the drum upwardly and is reeved about the mast sheave and extends downwardly and rearwardly and is reeved about the coupling means sheave and extends upwardly and is reeved about another mast sheave and is reeved about a plurality of platform sheaves and mast sheaves and from the last mast sheave extends downwardly and rearwardly and is reeved about another coupling means sheave and extends upwardly and is secured to the mast tip.

14. The system of claim 8 wherein the rope retractably and extensibly extends from the drum upwardly and is reeved about the mast sheave and extends downwardly and is reeved about the platform sheave and extends upwardly, downwardly and rearwardly between the coupling means sheave and a plurality of platform sheaves and mast sheaves.

15. The system of claim 8 wherein the rope retractably and extensibly extends from the drum upwardly and is reeved about the mast sheave and extends downwardly and rearwardly and is reeved about the coupling means sheave and extends upwardly and downwardly between a plurality of platform sheaves and mast sheaves.

16. The system of claim 8 wherein the rope retractably and extensibly extends from the drum upwardly and is reeved about the mast sheave and extends downwardly, rearwardly and upwardly between the coupling means sheave and a plurality of platform sheaves and mast sheaves.

17. The system of claim 8 wherein the rope retractably and extensibly extends from the drum upwardly and is reeved about the mast sheave and extends downwardly, rearwardly and upwardly between a plurality of coupling means sheaves, platform sheaves and mast sheaves.

18. The system of claim 8 further comprising a yoke anchor connection between the yoke and the rearward end of the platform.

19. The system of claim 18 wherein the the yoke anchor connection permits limited pivotal movement of the yoke.

20. A pivotally-mounted reeved counterweight system for a counterbalance-type crane characterized as having a rotatably-mounted platform about a vertical pivot axis on a ground-borne base, the platform having a forward end, a rearward end, a boom pivotally extending upwardly and forwardly from adjacent the forward end of the platform with a tip, the boom adapted for picking up a load, a mast pivotally extending upwardly and rearwardly from adjacent the forward end of the platform with a tip and a sheave mounted adjacent the tip on the mast with a pendant connecting the tips of the boom and the mast, a sheave mounted on the platform, a hoist drum mounted on the platform and a rope retractably and extensibly extending from the drum and reeved about the sheaves for moving the boom tip upwardly and closer to the vertical pivot axis or downwardly and away from the vertical pivot axis, the system comprises:

(a) a wheeled counterweight carriage supporting a counterweight;

(b) a yoke pivotally connected to both the carriage and the rearward end of the platform as to permit the counterweight force to rest on the ground; and (c) a sheave mounted on the yoke, wherein the rope retractably and extensibly extends from the drum upwardly and is reeved about the mast sheave and extends downwardly, rearwardly and upwardly between the yoke sheave and a plurality of platform sheaves and mast sheaves after which the rope is secured to the mast tip.

21. A pivotally-mounted reeved counterweight system for a counterbalance-type crane characterized as having a rotatably-mounted platform about a vertical pivot axis on a ground-borne base, the platform having a forward end, a rearward end, a boom pivotally extending upwardly and forwardly from adjacent the forward end of the platform with a tip, the boom adapted for picking up a load, a mast pivotally extending upwardly and rearwardly from adjacent the forward end of the platform with a tip and a sheave mounted adjacent the tip on the mast with a pendant connecting the tips of the boom and the mast, a sheave mounted on the platform, a hoist drum mounted on the platform and a rope retractably and extensibly extending from the drum and reeved about the sheaves for moving the boom tip upwardly and closer to the vertical pivot axis or downwardly and away from the vertical pivot axis, the system comprises:

(a) a wheeled counterweight carriage supporting a counterweight;

(b) a yoke having one extension pivotally connected to the carriage and a second extension pivotally connected to the rearward end of the platform; and (c) a sheave mounted on the yoke, wherein the rope retractably and extensibly extends from the drum upwardly and is reeved about the mast sheave and extends downwardly, rearwardly and upwardly between the yoke sheave and a plurality of platform sheaves and mast sheaves after which the rope is secured to the mast tip.

* * * * *